US007934949B2

(12) United States Patent
Mahoney

(10) Patent No.: US 7,934,949 B2
(45) Date of Patent: May 3, 2011

(54) CABLE CONNECTOR APPARATUS

(75) Inventor: William G. Mahoney, Suwanee, GA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 12/512,175

(22) Filed: Jul. 30, 2009

(65) Prior Publication Data

US 2011/0028023 A1 Feb. 3, 2011

(51) Int. Cl.
*H01R 13/73* (2006.01)

(52) U.S. Cl. ..... 439/557

(58) Field of Classification Search ..... 439/926, 439/680, 557, 502; 174/59
See application file for complete search history.

(56) References Cited

U.S. PATENT DOCUMENTS

| | | | | |
|---|---|---|---|---|
| 7,270,560 | B1 * | 9/2007 | Bodmann et al. | 439/355 |
| 7,641,501 | B2 * | 1/2010 | Uchikawa et al. | 439/362 |
| 2005/0202719 | A1 * | 9/2005 | Matthys et al. | 439/557 |

FOREIGN PATENT DOCUMENTS

JP 05217629 * 8/1993

* cited by examiner

*Primary Examiner* — Phuong K Dinh
(74) *Attorney, Agent, or Firm* — Patent Capital Group

(57) ABSTRACT

In one embodiment a connector-cable assembly includes a first connector assembly at a first end of an RF cable and a second connector assembly at a second end of the cable. The connector assembly may include an RF connector and a connector module having an orientation guide and means for releasably coupling the connector module to a panel to couple the RF connector to a complementary connector positioned behind the panel. The connector module may also include a strain relief.

20 Claims, 10 Drawing Sheets

CABLE CONNECTOR APPARATUS

TECHNICAL FIELD

The present disclosure relates generally to cable management and more particularly to devices for managing cables and connectors within an enclosure.

BACKGROUND

Proper cable management is important to ensure satisfactory performance of Community Access Television (CATV), fiber optic systems, and similar systems as increasingly sophisticated devices are employed in such systems which require ever tighter connection tolerances. The cable used in the CATV industry is sensitive to bend radius; and excessive bending of the cable can lead to degraded performance, and in the case of fiber optic cable, even breakage. In addition, stresses associated with the movement of cable can damage systems and degrade performance. For example, pulling forces on a cable may disconnect or damage cable connections and associated devices.

Further complicating cable management in CATV systems is the increasing use of moving parts in the vicinity of cables. For example, cables and connectors may be enclosed in housings that may be opened and closed, and/or placed near other movable parts such as access trays. This opening and closing of the node and the movement of the trays can lead to the undesired pinching, bending, twisting, and rotation of the cables and associated connectors. Furthermore, electronic components to which cables are to be connected are often installed behind protective panels thereby making it difficult to access, install, and orient the connectors and the associated cable in a desired manner.

OVERVIEW

Figure 1:
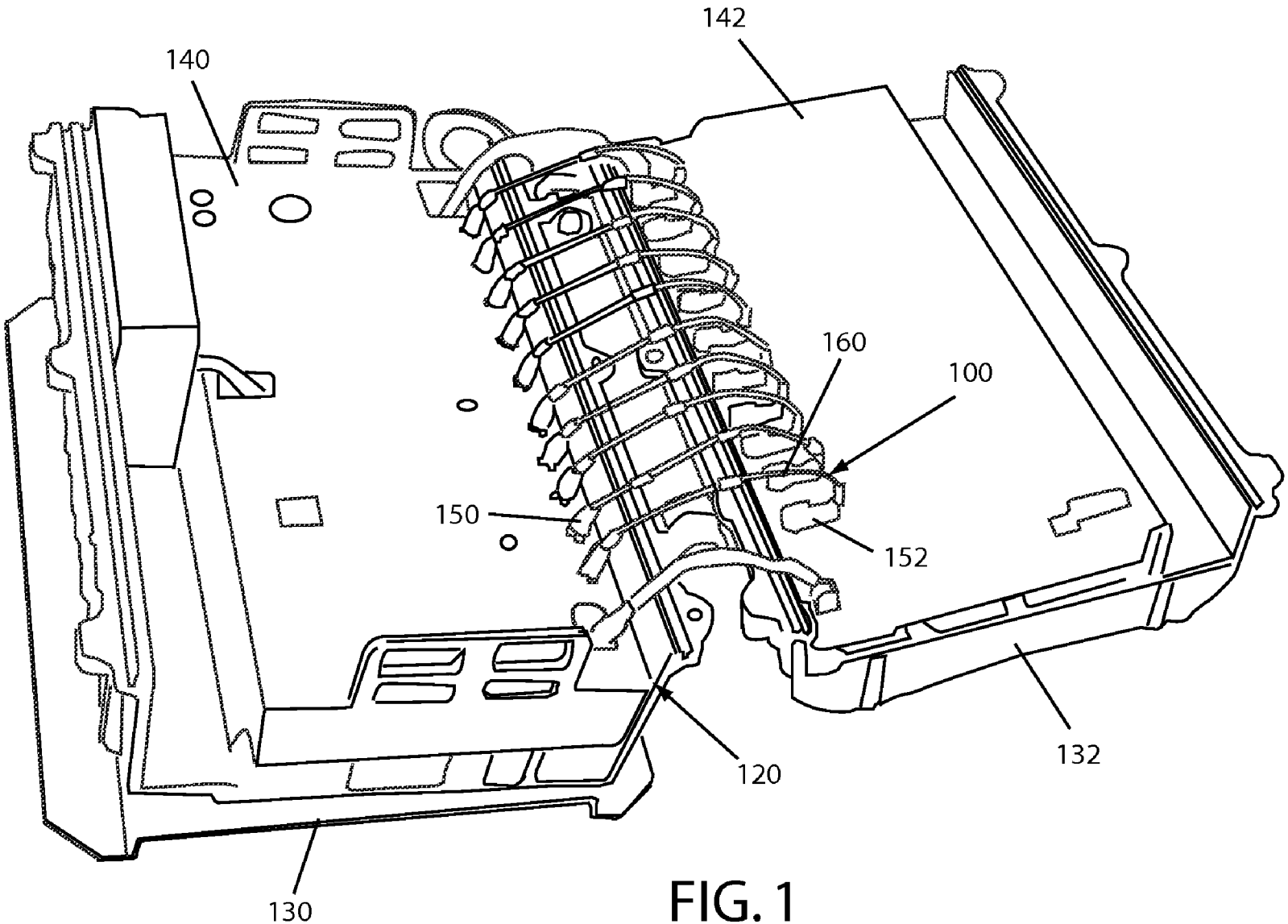
FIG. 1 illustrates an example connector-cable apparatus for managing radio frequency (RF) components and cable installed in an open node enclosure.

In an example embodiment, a connector-cable assembly (CCA) is provided that is configured to connect RF connectors with complementary RF connectors installed behind panels of a node housing and manage associated cable. The CCA allows for the easy interconnect and management of cable and the connection of the RF connectors. In an example embodiment, the CCA includes two connector assemblies (CAs) provided at opposite ends of a RF cable. The CAs may include a standard RF connector and a connector module (CM) for managing the RF connector and associated cable. The CM may include a housing attached to the RF connector that is configured for installation with a slot arrangement in a panel so as to connect the RF connector with a complementary connector installed behind the panel.

In an example embodiment, a connector module includes an orientation guide to key the connector module to the panel, and a latch to releasably couple the connector module to the panel in a manner that allows the connection of the RF connector with the complementary RF connector installed behind the panel. For example, the CM may be configured to engage with a slot arrangement of a panel to orient the CM in a desired orientation and secure the CM to the panel so that it is not unduly affected by the opening and closing of the node housing in which the panel is installed. The CM may also include a strain relief for managing forces applied to the cable to prevent disconnection of the RF connector.

In one example embodiment, a straight CA includes a CM configured for use with a straight RF connector. In another example embodiment a right angle CA includes a CM configured for use with a right angle RF connector. In an example embodiment of a CCA, a straight CA is provided at one end of a cable and a right angle CA at an opposite to form a connector-cable assembly well suited to interconnect a first complementary RF connector covered by a first panel on a first half of an open/closable node housing with a second complementary connector covered by a second panel on a second half of the open/closable housing.

DESCRIPTION OF EXAMPLE EMBODIMENTS

As required, exemplary embodiments of the present invention are disclosed. The various embodiments are meant to be non-limiting examples of various ways of implementing the invention and it will be understood that the invention may be embodied in alternative forms. The present invention will be described more fully hereinafter with reference to the accompanying drawings in which like numerals represent like elements throughout the several figures, and in which exemplary embodiments are shown. The figures are not to scale and some features may be exaggerated or minimized to show details of particular elements, while related elements may have been eliminated to prevent obscuring novel aspects. The specific structural and functional details disclosed herein should not be interpreted as limiting, but merely as a basis for the claims and as a representative basis for teaching one skilled in the art to variously employ the present invention. For example, while the exemplary embodiments are discussed in the context of RF and Sub Miniature version B (SMB) connectors, it will be understood that the present invention is not limited to RF connectors and may employ other connectors and other RF connectors.

Turning to the figures, FIG. 1 shows an example embodiment of a connector cable assembly (CCA) 100 installed in an open node housing 120 having first 130 and second 132 halves that may be opened and closed together in clamshell fashion, each half having a respective panel 140, 142 behind which electrical components are mounted. The CCA 100 includes a cable 160 having a first connector assembly (CA) 150 at a first end and a second CA 152 at a second end. In this example embodiment the first CA 150 is installed in the first panel 140 and the second CA 152 is installed in the second panel 142 so that the cable 160 extends across the open halves 130, 132. The CCA 100 allows the RF connectors to remain connected through the opening and closing of the node housing 120.

Figure 2:
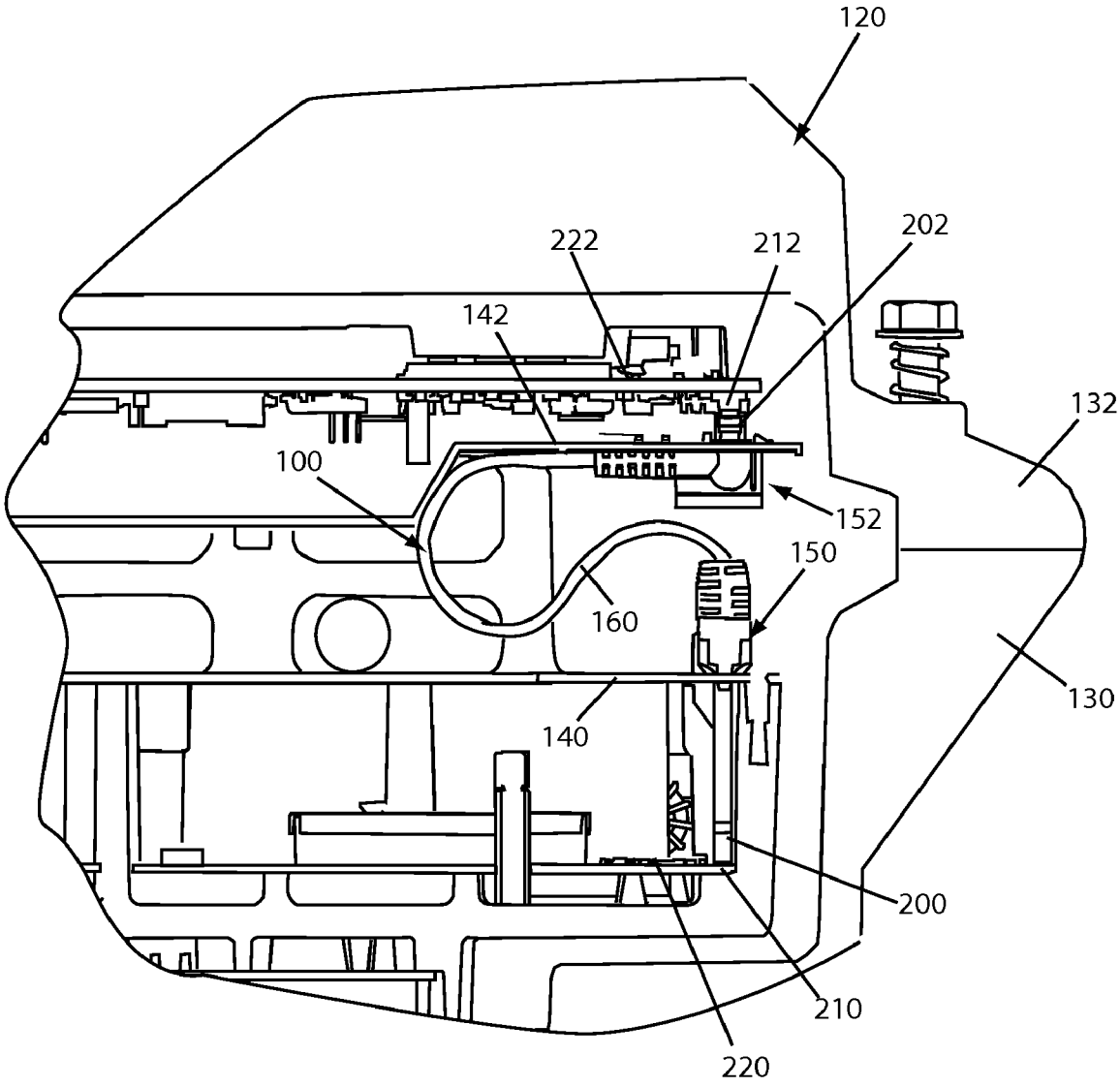
FIG. 2 illustrates an example connector-cable apparatus installed within a closed node enclosure.

FIG. 2 shows the CCA 100 of FIG. 1 in a closed node housing 120 in which a straight CA (SCA) 150 is installed in the first panel 140 to connect an RF connector 200 of the SCA 150 with a complementary RF connector 210 provided on a circuit board 220 mounted behind the first panel 140. A right angle CA 152 (RCA) having an RF connector 202 is installed in a second panel 142 to connect the RF connector 202 of the right angle CA 152 with a complementary RF connector 212 mounted on a circuit board 222 installed behind the second panel 142. The SCA 150 and RCA 152 are connected by an RF cable 160 to allow for interconnection of the first 220 and second 222 circuit boards through the CCA 100.

Figure 3:
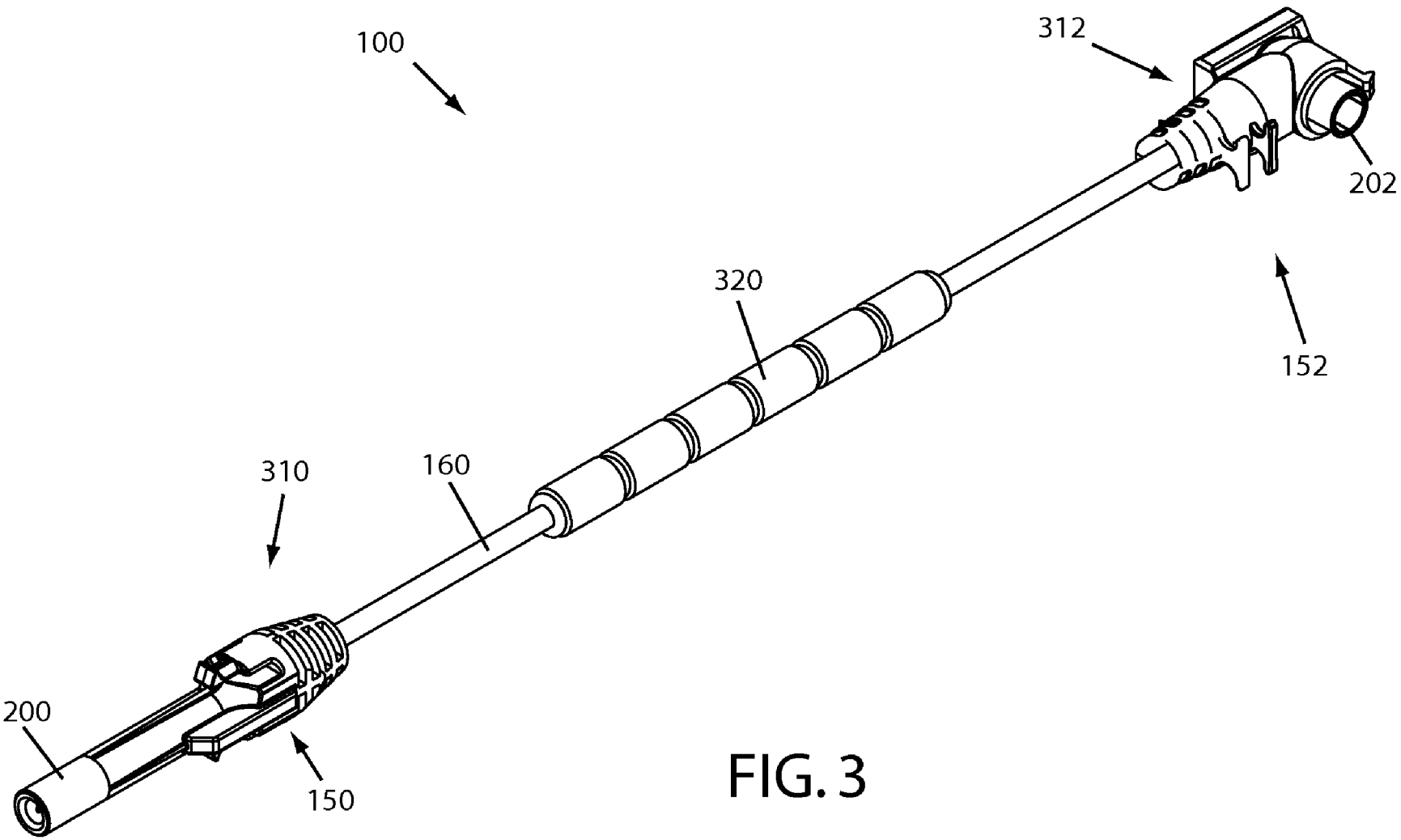
FIG. 3 is a perspective view of an example connector-cable apparatus.
Figure 4:
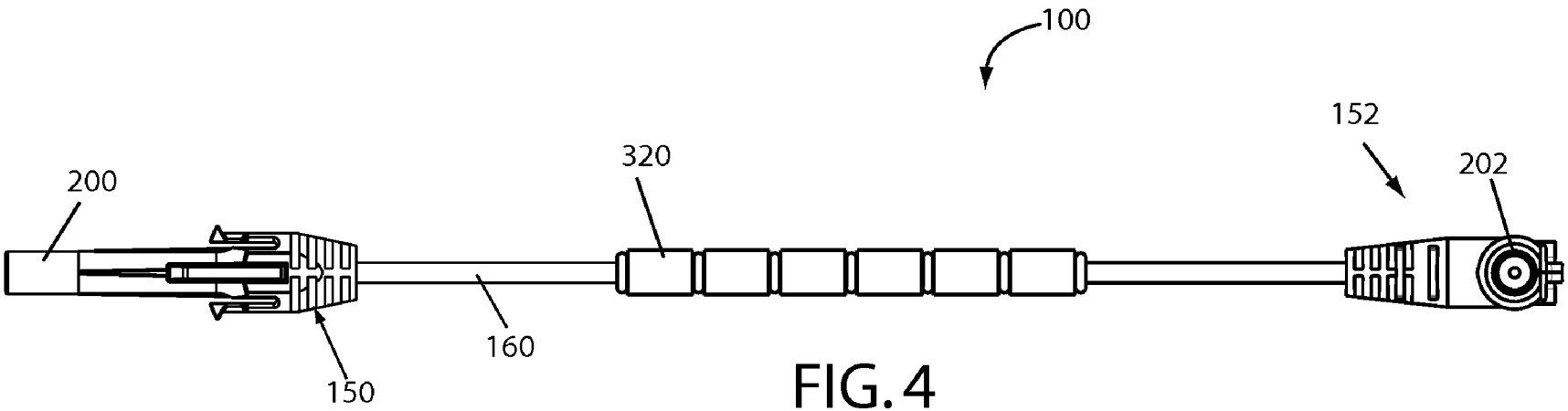
FIG. 4 shows a front view of the connector-cable apparatus of FIG. 3.
Figure 5:
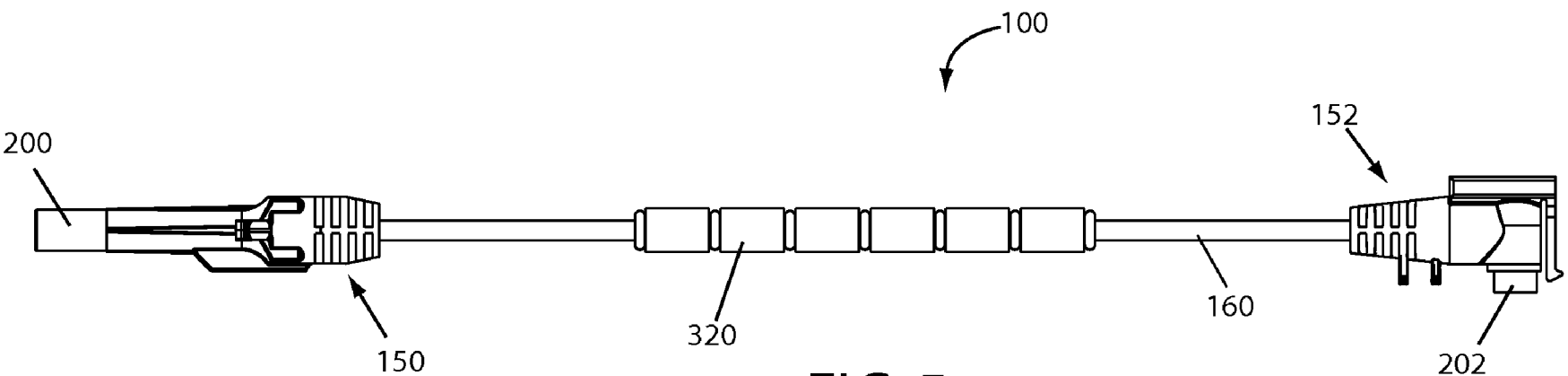
FIG. 5 shows a top view of the connector-cable apparatus of FIG. 4.

The CCA 100 may be provided with a plurality of features that allow it to be easily mounted to the panels 140, 142 to connect RF connectors 200, 202 with complementary connectors 220, 222 positioned behind the panels 140, 142 and manage the cable 160 to prevent disconnections and the undesired twisting, pinching, movement, and rotation of the cable 160 and RF connectors 200, 202 during from the opening and closing of the node housing 120 and associated movement of the node halves 130, 132. In the example embodiment shown in FIGS. 3-5, the CCA 100 has an SCA 150 at a first end 310 and a RCA 152 at a second end 312. Each CA 150, 152 may include an RF connector 200, 202 and a connector module that attaches to the RF connector 200, 202 and cable 160. In this example embodiment, the SCA 150 includes a straight RF connector 200 and the RCA 152 includes a right angle RF connector 202. The CCA 100 may also include beads 320 for to reduce unwanted signal propagation. For example, the beads may be made of graphite, ferrite, or similar material as known in the art and be slidably mounted to the cable 160.

Figure 6:
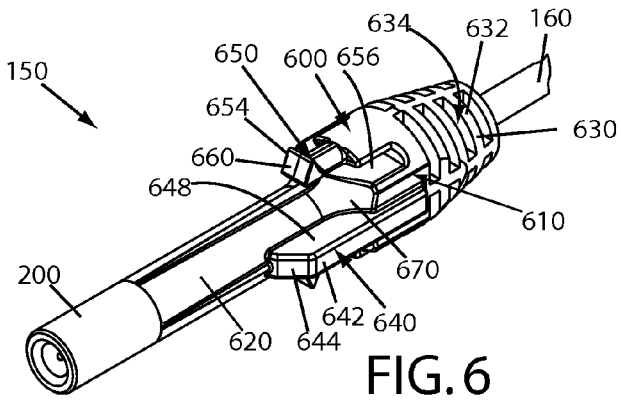
FIG. 6 shows a top perspective view of an example embodiment of a straight connector assembly.
Figure 7:
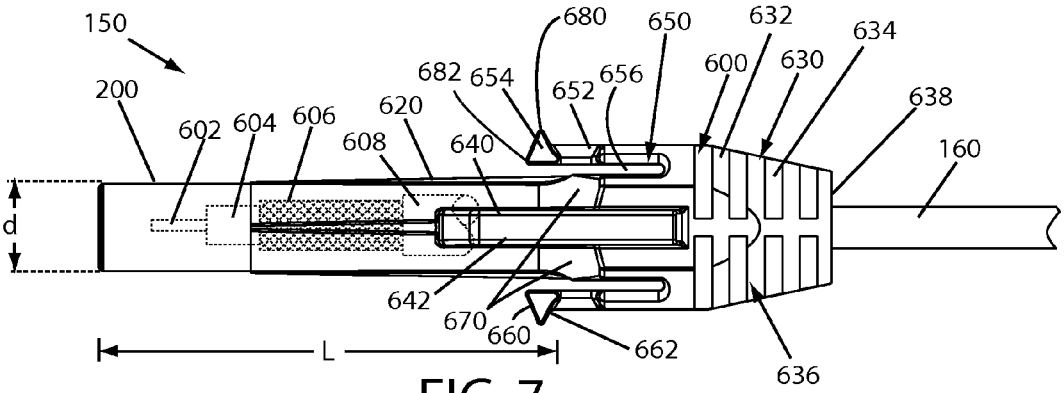
FIG. 7 shows a front view of the straight connector assembly of FIG. 6.

In the example embodiment shown in FIGS. 6-7 the SCA 150 includes a straight SMB connector 200 and a straight connector module SCM 600 that attaches to the RF connector 200 and cable 160. The SCM 600 (FIG. 8) may include a hollow body 610 having an open distal end 710 for attachment to the RF connector 200 and an open proximal end 712 for receiving the cable 160 therethough. The SCM 600 may be made of Acrylonitrile Butadiene Styrene (ABS) thermoplastic and overmolded the RF connector 200 and cable 160 such as by injection molding and the body 610 may be made of a flexible plastic such a polyvinyl chloride (PVC). For example, the cable assembly may be fabricated and then placed in the molding tool to create the overmold.

The SCA 150 may be configured to engage an arrangement of slots 900 (FIG. 9) in the panel 142. The slot arrangement 900 may include a connector opening 910 sized to receive the RF connector 200 therethrough. The RF connector 200 may be attached to an extension 620 of the SCM 600 extending from the main portion of the body 610. The extension 620 may have a circular cross section generally similar to that of the RF connector 200 so that both the RF connector 200 and the extension 620 can extend through the connector slot 910 in the slot arrangement 900.

The cable 160 may extend through the open end 712 and the extension 620 and terminate at the RF connector 200. As seen in dashed lines in FIG. 7, the cable 160 may be standard coaxial RF cable known in the art and include a center conductor 602, a coaxial dielectric 604, a coaxial braid conductor 606 and an outer protective cover 608. The cable 160 may be terminated with the RF connector 200 as known in the art so that the RF connector 200 is configured for coupling with a complementary RF connector 220 to establish a RF connection. In this example, the RF connector 200 is a female SMB connector that mates with a complementary male SMB connector installed within the node housing behind panel 140.

The extension 620 may be configured for extending through the panel 140 to connect the RF connector 200 with a complementary RF connector 210 behind the panel 140. For example, the extension 620 may be configured to extend through a connector opening 910 of the slot arrangement 900 (FIG. 9) in the panel 140, so that the RF connector 200 of the SCA 150 couples with the complementary connector 210 (FIG. 2). In an example embodiment, the extension 620 has a diameter d (FIG. 7) roughly equal to the diameter of the RF connector 200 and less than the slot diameter SD of the connector slot 910 (FIG. 9) so that when the SCA 150 is installed in the panel 140, the RF connector 200 and the extension 620 extend through the panel 140 to position the RF connector 200 for coupling with the complementary connector 210 (FIG. 2). In the example embodiment, an SMB connector 200 is shown but other connectors and cables could be used, such as, by way of example and not limitation, power & control connectors. In the example embodiment, d is about 0.250 inch and the connector slot diameter, SD, is about 0.300 inch.

A strain relief 630 may be provided at a proximal end of the body 610. The strain relief 630 may include a hollow body 636 (FIG. 7) having an open end 638 for receiving the cable 160 therethrough. The strain relief 630 may be made of resilient material such as PVC having a shore hardness of about 55-70 that allows flexing when forces are applied to the cable 160. The strain relief body 636 may include an arrangement of ribs 632 and openings 634 that taper from the body 610 toward the cable 160 and allow for the bending and flexing of the body 636 to relieve stresses and limit movement of the cable 160 to prevent disconnection of the cable and/or an undesirable bending of the cable beyond the desired bend radius. The strain relief body 636 may be configured for engagement with the body 610 of the SCA 150. For example, a distal end of the strain relief 630 may include a protrusion (not shown) that is received in a recess (not shown) in a proximal end of the CA body 610 so that the strain relief forms part of the SCA 150.

The SCM 600 may also be configured to key to and releasably engage the panel 140. For example, in the exemplary embodiment of the SCM 600 shown in FIG. 6, the SCM 600 may include a guide 640 for keying with a guide slot 920 and latches 650 for releasably engaging latch slots 930.

Figure 8:
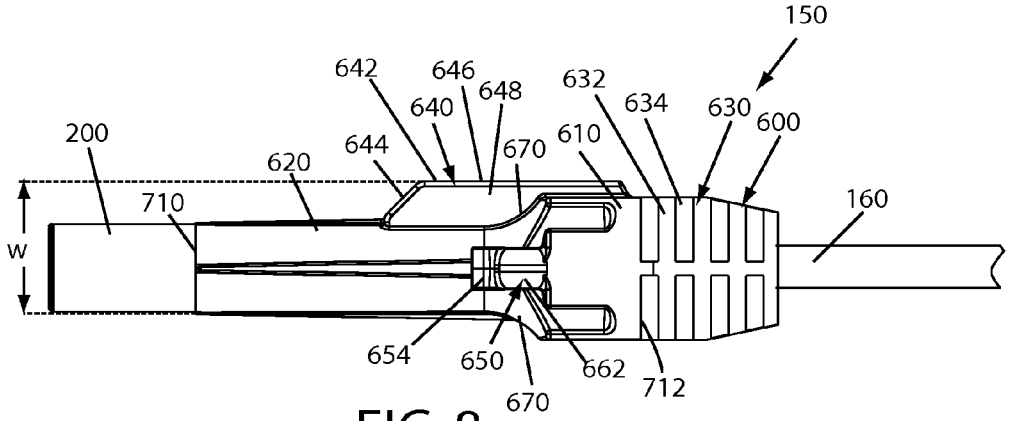
FIG. 8 shows a bottom view embodiment of the straight connector assembly of FIG. 7.

As seen in FIGS. 6-8, the SCM 600 may include a guide 640 for keying with a guide slot 920 (FIG. 9) of the slot arrangement 900 in the panel 140. In the example embodiment shown in FIG. 6, the guide 640 comprises a raised portion 642 having a generally rectangular cross section adapted to key with the rectangular-shaped guide slot 930 in the panel 140. The guide 640 may extend along the extension 620 and include an upper surface 646, sidewalls 648 and an angled end wall 644. The guide 640 may have a length such when the SCA 150 is mounted to the panel 140 the guide 640 extends on both sides of the panel 140. This arrangement prevents rotation of the SCA 150 by the abutment of the guide sidewalls 648 against the edges 922 of the guide slot 920 (FIG. 9) in the panel 140.

Figure 9:
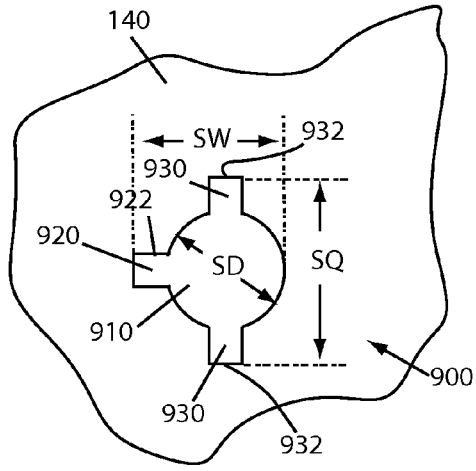
FIG. 9 shows an example slot arrangement in a panel for use with the connector assembly of FIG. 6.

As shown in FIGS. 8 and 9, in an example embodiment, the guide 640 and the body 610 of the SCM 600 have a combined width of w which is slightly less than the combined width SW of the connector opening 922 and guide slot 920 in the panel 900 to allow passage of the guide 640. In an example embodiment the w is about 0.400 inches and SW is about 0.425 inches. Because the width w is greater than the diameter SD of the connector opening 910, to install the SCA 150 into the panel 140, the SCA 150 must be oriented so that the guide 640 is aligned with the guide slot 920.

The SCM 600 may also include means for releasably securing the SCA 150 to the panel 140. In the example embodiment shown in FIGS. 6-10B two latches 650 are provided, each on an opposite side of the body 610. The latches are adapted to releasably engage the latch slots 630 of the slot arrangement 900 of the panel 140. An example latch 650 includes a latch arm 652 mounted to the body 610 in cantilever fashion so that the latch arm 652 extends parallel to the extension 620 with a space 656 therebetween. As explained in more detail below, the latch arms 652 may be moved between an outer latch position and a compressed release position to allow the SCA 150 to be secured to and released from the panel 140 as desired.

In an example embodiment, tabs 654 may be provided at a distal end of the latch arms 652. The tabs 654 may be shaped to extend outwardly from the latch arm 652 so that the distance between the outer tips of the tabs 654 is a distance q1 when the latch arms 652 are in an initial relaxed condition shown in solid lines in FIG. 10A. The distance q1 being greater that the slot distance SQ between the outer edges 932 of the latch slots 930 shown in FIG. 9.

The tabs 654 may include an angled distal surface 660 and a rear contact surface 662, an outer end 680, and a forward tip 682. The angled surface 660 may serve as a ramp that engages the top edge 932 (FIG. 9) of the latch slot 920 when the SCM 600 is inserted into the panel openings 900.

Figure 10A:
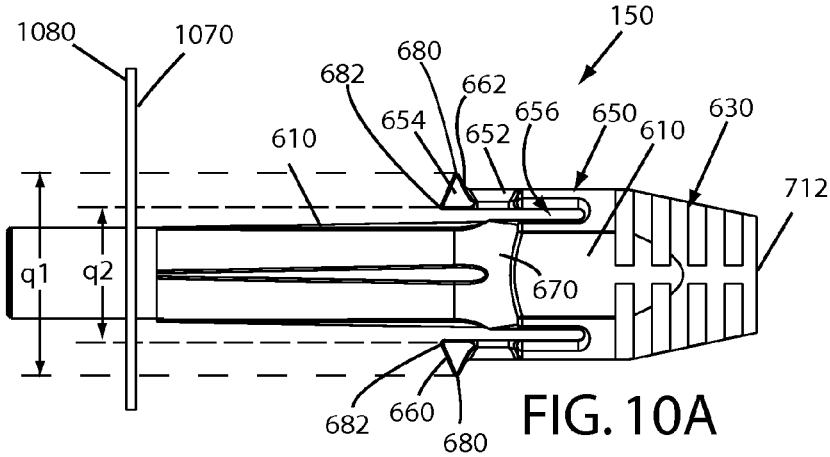
FIG. 10A shows an example embodiment of a straight connector assembly of FIG. 7 being inserted into a panel.
Figure 10B:
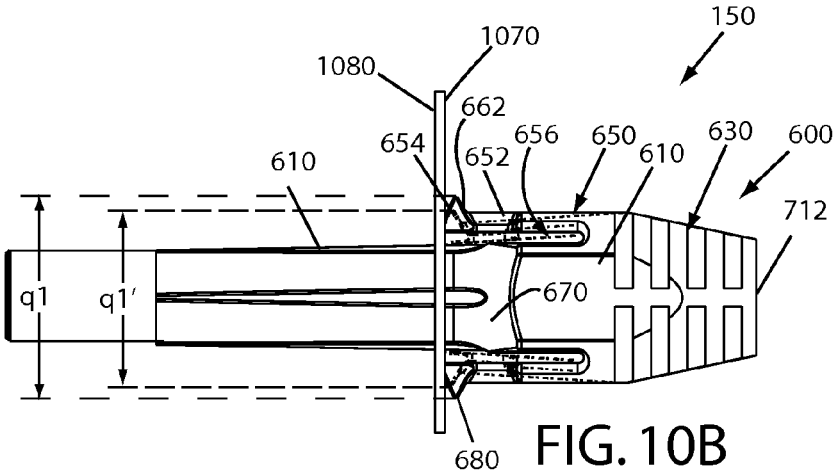
FIG. 10B shows the straight connector assembly of FIG. 10A being installed in the panel.
Figure 10C:
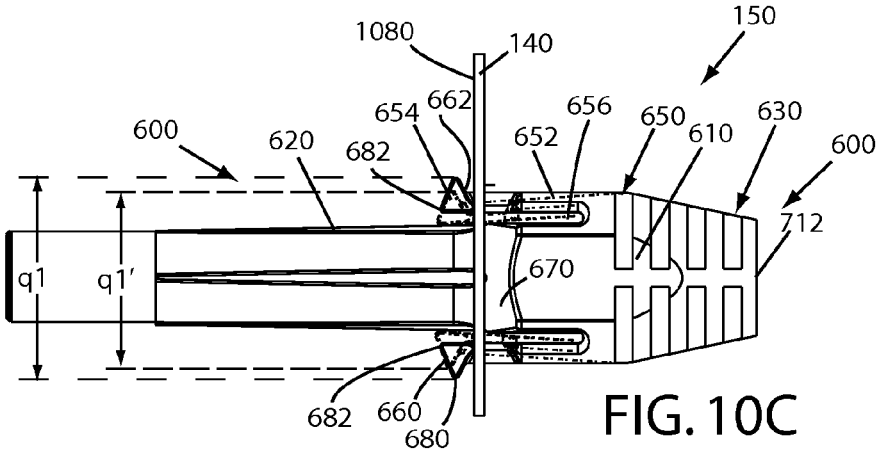
FIG. 10C shows the straight connector assembly of FIGS. 10A and 10B installed in the panel.

FIGS. 10A-C show the installation of the SCA 150 into the panel 140. As seen in FIG. 10A in an initial condition the distance between the outer ends 680 of the latch tabs 654 is a distance q1 which is greater than the slot width SQ between the edges 932 of the latch slots 930. The distance between the forward tips 682 of the latch tabs 654 is a distance q2 which is less than the slot width SQ. When the SCA 150 is inserted into panel, the RF connector 200 and extension 620 extend through the connector opening 910 as discussed above. As the SCA 150 is further inserted through the panel, the guide 640 must be keyed to the guide slot 920 to allow further insertion. This orientation will align the latch members 654 with the latch slots 930.

As the SCA 150 is still further inserted through the panel 140 the forward tips 682 of the latch tab 654 extend into the latch slot 930 and the ramps 660 of the latch tabs 654 engage the edges 932 of the latch slots 930. With further insertion, the latch tabs 654 are forced inward toward the centerline as the slot edges 932 move along the ramps 660. The cantilevered connection of the latch arm 652 to the body 610 acts as a hinge so that the latch arms 652 are moved to a compressed condition shown in dashed lines in FIG. 10B in which the outer ends 680 of the latch tabs 654 are spaced apart a distance q1' that is less than the width SQ of the latch slots 930 to allow passage of the tabs 654 through the latch slots 630 to the other side of the panel 104.

As shown in FIG. 10C, once the tabs 654 have passed through the latch slots 930 by the continued insertion of the SCM 600 through the slot arrangement 900, the latch arms 652 flex outward to return to the initial condition wherein the tab ends 680 are again spaced apart a distance q1 that is wider than the latch slot distance SQ. In this position, the rear contact surface 662 of the latch tabs 654 abut the obverse side 1080 of the panel 140, thereby preventing movement of the tabs 654 in the reverse direction and preventing removal of the SCA 150 from the panel 140.

The body 610 may have an increased cross section that forms an abutting surface 670 to limit the further insertion or forward movement of the SCM 600 through the panel 140 (FIG. 10C). The latch arms 652 and the abutting surface 670 of the body 610 are arranged so that in the installed position shown in FIG. 10C the panel 140 is held between the rear contact surface 662 of the tabs 654 and the front contact surface 670 of the body 610 to limit the movement of the SCA 150. The guide 640 also prevents rotation of the SCA 150 so that the RF connector 200 is placed in a desired position and orientation for connection with the complementary connector 210 positioned behind the panel 140 (FIG. 2). The SCM 600 is configured to extend the connector 200 a length L (FIG. 7) so that the RF connector 200 coupled to the complementary RF connector positioned a distance behind the panel 140. In an example embodiment for use with Cisco Systems, Inc.'s Digital Service Access Node (DSAN) the distance L is about 1.263 inch.

To remove the SCM 600 from the panel 140, a user can simply squeeze the SCM 600 so that the latch arms 652 are again forced inward to the compressed condition so that the latch tabs 654 can be removed through the tab slots 630. Thus, the SCM 600 can be coupled to and removed from the panel 140 by moving the latch arms 652 between a locked condition and a released condition.

The SCM 600 is arranged so that in the coupled position shown in FIG. 10C, the RF connector 200 positioned at the end of the SCM 600 is coupled to the complementary RF connector 210 positioned within the node housing (FIG. 2). Thus, the slot arrangement 900 is aligned with the complementary RF connector 220 so that a user can establish a connection with the complementary RF connector 210 by simply installing the SCA 150 in the panel 140. The keying and engagement of the SCA 150 to the panel prevents the undesired movement and rotation of the RF connector 200.

Figure 11:
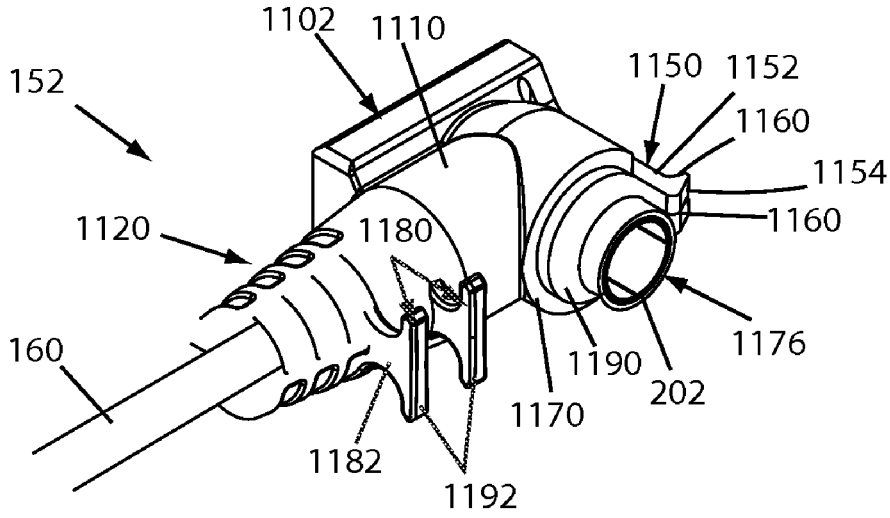
FIG. 11 shows a perspective view of an example right angle connector assembly.
Figure 12:
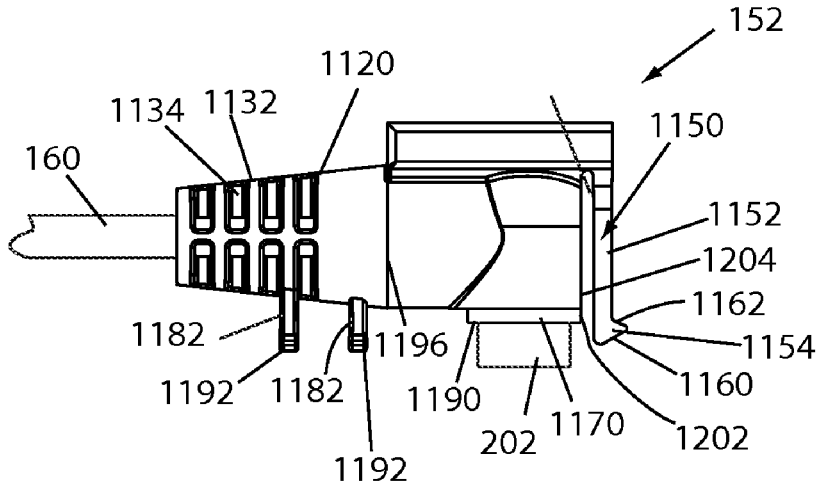
FIG. 12 shows a top view of the right angle connector of FIG. 11.
Figure 13:
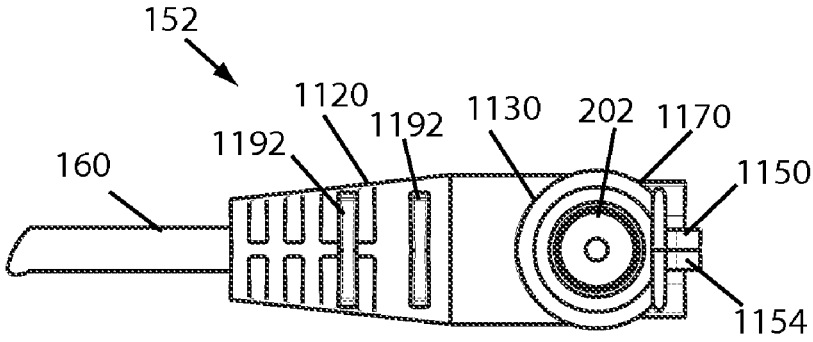
FIG. 13 shows a bottom view of the right angle connector assembly of FIG. 12.
Figure 14:
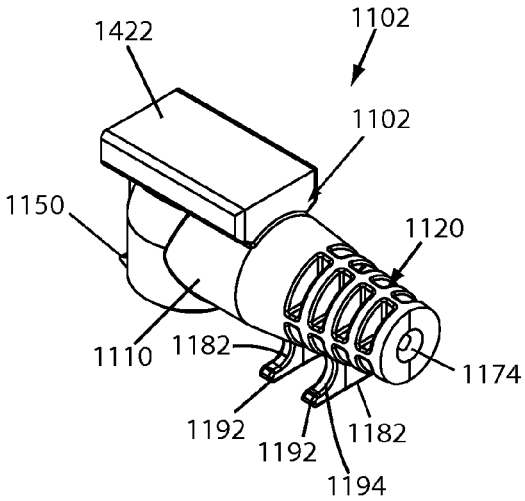
FIG. 14 shows a perspective view of an example embodiment of a right angle connector module for use with a right angle RF connector.
Figure 15:
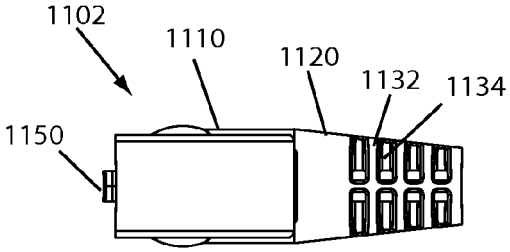
FIG. 15 shows a top view of the right angle connector module of FIG. 14.

As seen in FIGS. 11-13, the CCA 100 may also include a right angle connector assembly RCA 152 provided on an opposite end of the cable 160 from the SCA 150. The RCA 152 may include an RF connector 202 and a right angle connector module RCM 1102 attached to the RF connector 202. The RCM 1102 may include a hollow body 1110 configured to hold the RF connector 202 and receive the associated cable 160. Unlike the SCA 150 in which the SCM 600 was configured for use with a straight RF connector 200, the RCM 1102 is configured for use with a right angle RF connector 202. For example, as seen in FIG. 14 the body 1110 of the RCM 1102 may have a first open end 1174 to receive the cable 160 and a connector end 1176 having an opening perpendicular to the first open end 1174 for the extension of the mating end of the RF connector 202. The cable 160 may be terminated in the right angle RF connector 202 as known in the art and the RCM 1102 may be overmolded the RF connector 202 and cable 160 to form the RCA 152.

The RCM 1102 may be configured for mounting on a panel 142 by engagement with a slot arrangement 1800 (FIG. 18) provided on the panel 142. In the example embodiment shown in FIG. 18, the slot arrangement 1800 comprises a connector slot 1810, guide slots 1820, and a latch slot 1830, the latch slot 1830 and the connector slot 1810 being connected. In the example embodiment, the connector end 1176 of the body 1110 may have a generally circular raised portion 1190 having a generally planar surface that forms a concentric ring about the RF connector 202. The raised portion 1190 may be sized to fit through the connector slot 1810 of the slot arrangement 1800. The body 1110 may also include an abutment surface 1170 forming a concentric ring about the raised portion 1190, the abutment surface 1170 arranged to abut a surface of the panel 142 when the RCA 152 is installed in the panel 142. While generally circular in shape, the raised portion 1190 and the abutment surface 1170 may each have a cutout that forms a generally flat portion 1202, 1204 (FIG. 12) to make the cross section obround.

The RCM 1102 may have strain relief 1120 provided at the proximal end 1196 of the body 1110. The strain relief 1120 may be similar to the strain relief 630 discussed above in reference to the SCM 150 and include ribs 1132 and cutouts 1134. The RCM 1102 may also include an orientation guide 1180 adapted for keying with the panel 142. In the example embodiments of FIGS. 11-17, the orientation guide 1180 is in the form of two guide legs 1182 provided on the strain relief 1120 that extend parallel to the RF connector 202 and are adapted for engaging guide slots 1820 in the panel 142. The guide legs 1182 may curve downward to outwardly extending feet 1192 having a width y that is greater than the slot width SY of the guide slots 1820. The guide legs 1182 may have a cross section sized to fit through the guide slots 1820. The feet may be arranged so that once the feet 1192 are inserted through the guide slots 1820 an upper surface 1194 of the feet abut the underside surface 1704 of the panel 142. The orientation guides 1180 may be made of the same material as the strain relief 1120, such as PVC or similar material that provides sufficient flexibility to allow for the insertion of the feet 1192 through the guide slots 1820.

The RCM 1102 may also include means for releasably securing the RCA 1102 to the panel 142. In an example embodiment, a latch 1150, similar to the latch 650 of the SCM 600 is provided that is adapted to releasably engage a latch slot 1830 of the slot arrangement 1800.

In an example embodiment the latch 1150 includes a latch arm 1152 mounted in cantilever fashion to the body 1110 adjacent the connector opening 1810 so that the latch arm 1152 extends parallel the RF connector 202 with a space 1156 therebetween. The latch arm 1152 may include a retaining tab 1154 having an outer end 1184, a forward tip 1186, an angled surface 1160 that serves as a ramp when installing the latch 1150, and an abutting surface 1170 for retaining the latch 1150 to the panel 141 once installed.

Figure 17A:
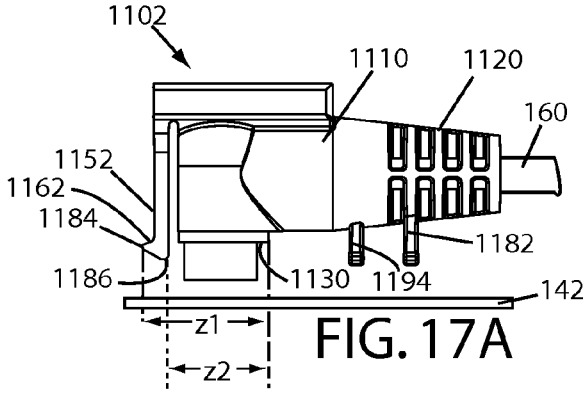
FIG. 17A shows a right angle connector assembly prior to installation in a panel.
Figure 17B:
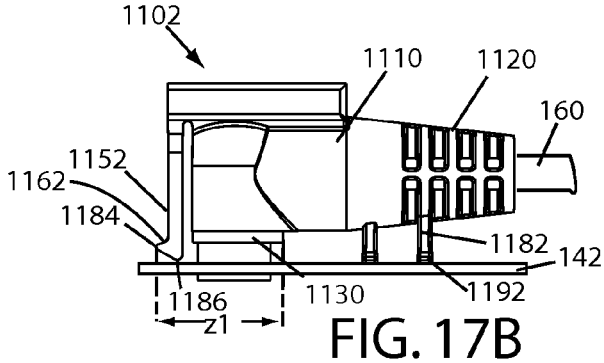
FIG. 17B shows the right angle connector assembly of FIG. 17A being installed in the panel.
Figure 17C:
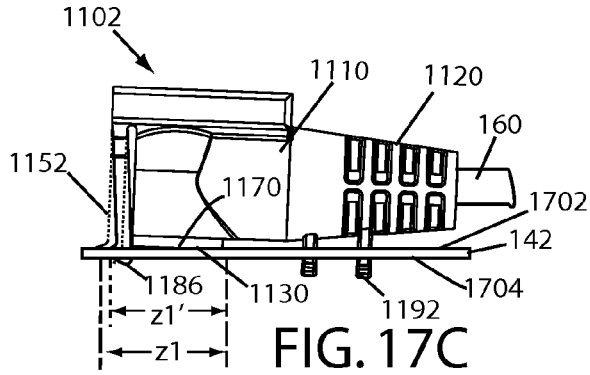
FIG. 17C shows the right angle connector assembly of FIG. 17B being installed in the panel.
Figure 18:
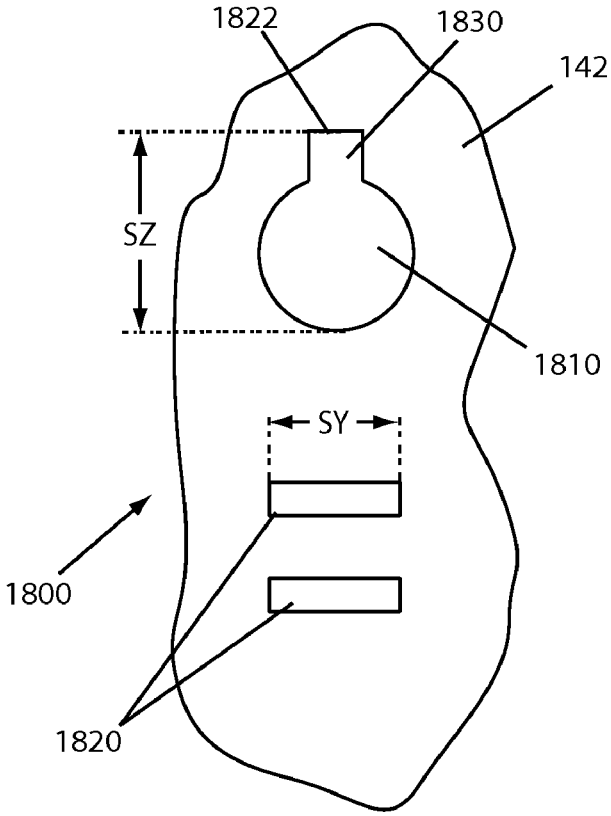
FIG. 18 shows an example slot arrangement for use with the right angle connector assembly of FIG. 11.
Figure 19:
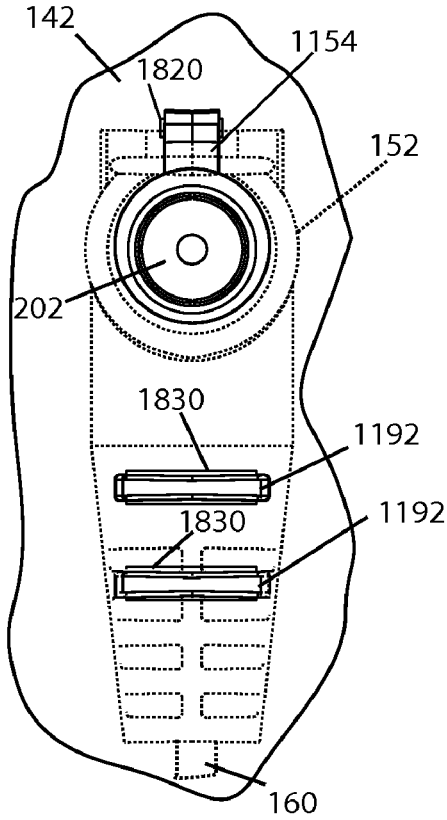
FIG. 19 shows an example embodiment of a right angle connector assembly installed in a panel.

In an initial condition prior to mounting the latch 152 to the panel 142 the latch arm 152 is essentially straight so that from the outer end 1184 of the retaining tab 1154 to the outer edge of the raised portion 1190 is a distance z1 which is greater than the slot width SZ of the connector slot 1810 and latch slot 1830 (FIG. 18). As shown in FIG. 17B, the distance between the forward tip 1186 and the outer edge of the raised portion, z2, is less than the slot diameter SZ so that when the RF connector 202 of the RCA 152 is inserted into the connector slot 1810 the edge tip 1186 is inserted into the latch slot 1830 (FIG. 17C). As seen in FIG. 17C with further insertion, the angled surface 1160 of the retaining tab 1154 engages the edge 1822 of the latch slot 1830.

Continued insertion of the RCM 1150 forces the retaining tab 1154 inward to flex the latch arm 1152 from the initial position to a compressed position shown in dashed lines in FIG. 17C that allows the retaining tab 1154 to pass through the latch slot 1820 to the other side of the panel. For example, the latch arm 1152 may be forced against the flat portions 1202, 1204 of the cutouts of the body in order to fit through the latch slot 1830. The tab 1154 of the latch 1150 effectively filling in the incomplete portion of the circle of the raised portion 1190 when the latch 1150 is compressed. Further insertion of the RCM 1102 is prevented by the abutment of an abutment surface 1170 of the body against the top surface 1702 of the panel 142. Once the retaining tabs 1154 have moved through the latch slot 1830, the latch arm 1152 springs back to its original condition shown in solid lines in FIG. 17D so that once again the outer end 1184 of the latch tab 1154 is spaced a distance z1 from the edge of the raised surface 1190 with the abutment surface 1162 abutting a rear surface 1704 of the panel 142.

Figure 16:
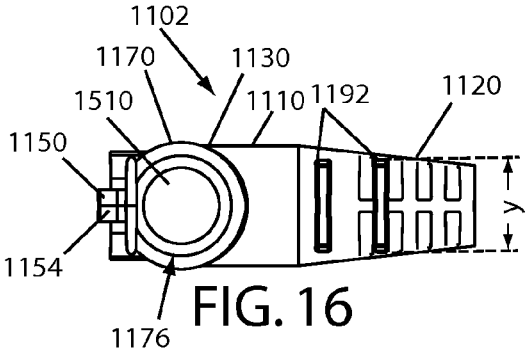
FIG. 16 shows a bottom view of the connector module of FIG. 14.
Figure 17D:
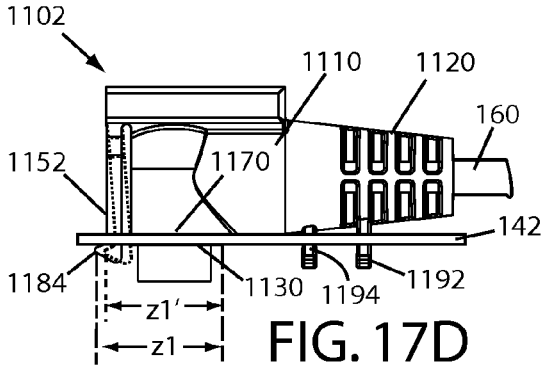
FIG. 17D shows the right angle connector assembly of FIG. 17C installed in the panel.

Removal of the latch arm 1152 is prevented by the contact surface 1162 of the retaining tab 1154. As seen in FIG. 17D, in the installed position the RCA 152 is coupled to the panel 142 with the panel 142 positioned between the abutting surface 1170 of the body 1110 and the abutting surface 1162 of the retaining tab 1154 and the abutting surface 1194 of the feet 1192 of the orientation guides 1180. To remove the RCA 1102 from the panel, a user may simply compress the latch arm 1152 to move the latch tab 1154 within the latch slot 1830 and pull the latch arm 1152 out of the panel 142 and rotate the RCM 1102 to remove the feet 1192 of the orientation guides 1180. This arrangement thus allows the RCA 152 to be coupled to and released from the panel 142 as desired and allows the RCA 152 to be mounted generally parallel to the panel 142 as shown in FIG. 16. The orientation guides 1180 key the RCA 152 to the panel 142. The RCA 152 is configured to allow the RF connector 202 to be coupled to a complementary connector 212 mounted behind the panel 142 by installing the RCA 152 to the panel.

Thus, as seen in FIGS. 17A-17D to install the RCA 152 and connect the RF connector 202 a user can angle the feet 1192 of the orientation guides 1180 through the guide slots 1830 in the opening arrangement 1800 in the panel 142, insert the RF connector 202 through the connector opening 1810, and push the latch tab 1154 through the latch slot 1830. The feet 1192 of the guides 1180 may be inserted through the guide slots such as by angling the RCM 1102 to pass a first foot 1192 through a guide slot and the rotating the RCM 1102 to move the second foot through the guide slot so both feet 1192 are placed on an opposite side 1704 of the panel 142. The legs 1182 and feet 1192 may be made of the same material as the strain relief with sufficient flexibility to allow insertion of the feet through the slot and sized so that when installed the RCA 152 is held in a position generally parallel to the panel with the RF connector 202 coupled to the complementary connector 212.

The body may increase in cross section to a size greater than the opening 1810 to prevent the RCA 152 from being pushed through the panel 142. The body 1110 of the RCM 1102 may also include a generally planar back 1422 for use as a finger grab feature that reduces toque on the connection and maintains its generally parallel position with the panel when installed.

Figure 20:
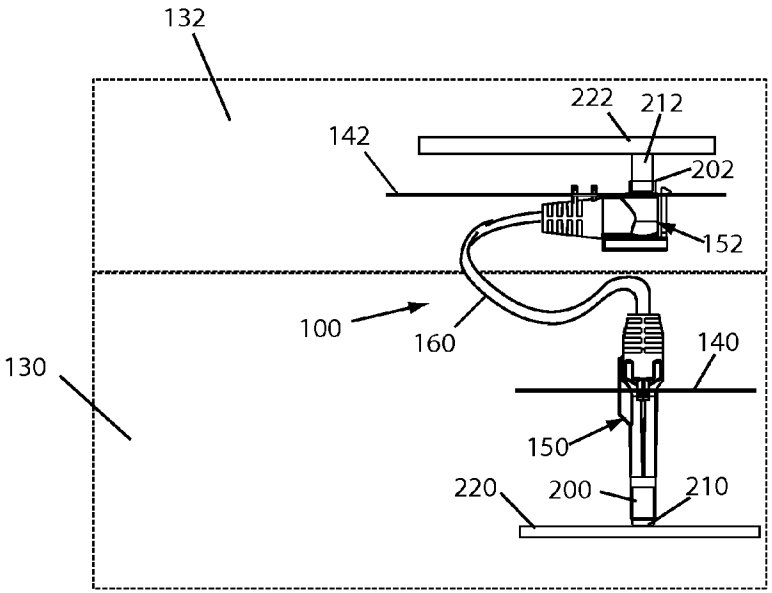
FIG. 20 shows a connector-cable assembly installed in an open node housing.
Figure 21:
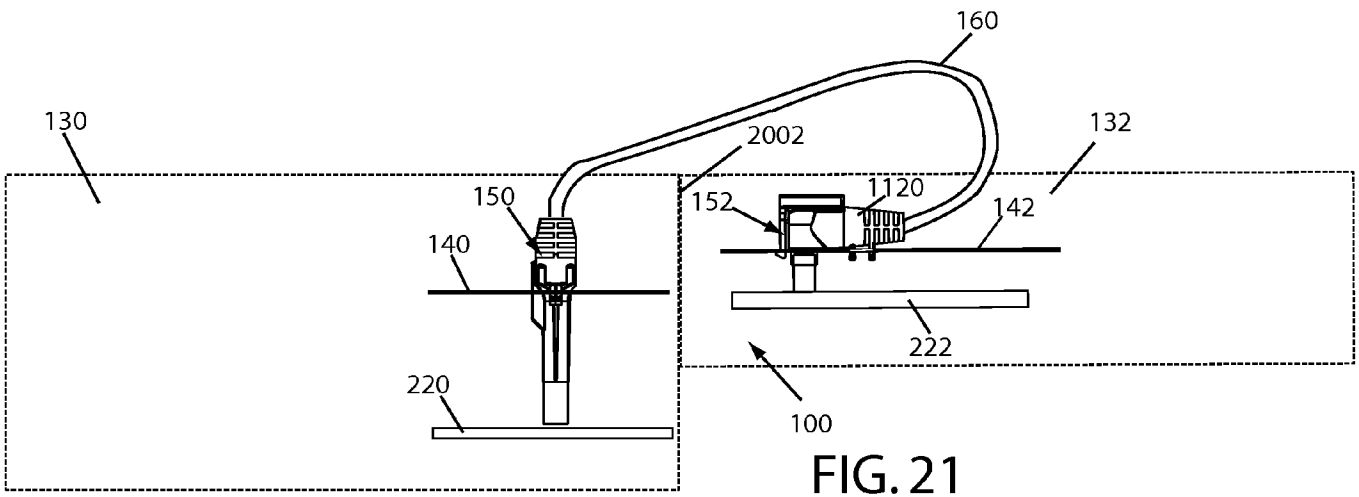
FIG. 21 shows a connector-cable assembly installed in a closed node housing.

FIGS. 20 and 21 show the CCA 100 installed in a network node housing 120, such as a DSAN node from Cisco, to connect RF connectors 200, 202 of the CCA 100 with complementary connectors 210, 212 positioned behind panels 140, 142 in the node housing 120. The CCA 100 includes a SCA 150 attached to a first end of a cable 160 and a RCA 152 attached to the opposite end of the cable 160. Connectors 210, 212 are housed behind panels 140, 142 in a first half 130 and second half 132 of the housing, respectively. The panels 140, 142 are provided with slot arrangements 900 (FIG. 9) and 1800 (FIG. 18) for use with the SCM 150 and RCM 152.

The SCM 150 and RCM 152 may be installed in the panels 140, 142 as discussed above with the SCA 150 and RCA 152 keyed to the panels 140, 142 by the slot arrangements 900, 1800 in a desired fashion. In this example embodiment, the slot arrangements 900, 1800 are arranged so that the RF connectors 200, 202 are aligned across the node halves 130, 132 so that the cable 160 extends straight across the node without twisting. The RCA 152 is coupled to the panel 142 so that the cable 160 extends out of the strain relief 1120 away from the hinge line 2002 and loops back to the SCA 150 in the other node half 130. Because the RF connectors 200, 202 are housed in the SCA 150 and RCA 152 which are secured to and keyed to the panels 140, 142, the cable 160 is not twisted by opening and closing of the housing, and the RF connectors 200, 202 remain connected.

When the node 120 is moved to a closed condition shown in FIG. 21, the cable 160 is not twisted or undesirably pulled as the SCA 150 and RCA 152 are held in their desired positions relative the panels 140, 142 in their keyed positions. This allows the node housing 120 to be opened and closed without damaging the connection between the RF connectors 210, 212 and their respective complementary connectors 220, 222. In addition, the forces applied to the cable 160 are not readily transmitted to the RF connectors 200, 202 due to the strain reliefs 630, 1120. Furthermore, the latching mechanisms prevent the inadvertent removal of the SCA 150 and RCA 152 and disconnection of the RF connectors 200, 202. In this example, the complementary RF connectors 220, 222 are aligned within the node with the first complement RF connector 210 positioned a greater distance behind the panel 140 than the second complementary RF connector 212.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

What is claimed is:

1. An apparatus, comprising:

a radio frequency (RF) cable;

a connector assembly provided at an end of the RF cable, the connector assembly having an RF connector and an RF connector module;

a second connector assembly provided at a second end of the RF cable, wherein the connector assembly is adapted to key to a panel and couple the RF connector with a complementary RF connector positioned behind the panel; and a node housing element divided into a first portion and a second portion, the portions including a respective one of the connector assemblies, and wherein the first and second portions are secured together in a clamshell configuration such that opening and closing the node housing element allows the RF connectors to remain connected.

2. The apparatus of claim 1, wherein the second connector assembly is configured to key with a second panel and couple a second RF connector of the second connector assembly with a second complementary RF connector positioned behind the second panel.

3. The apparatus of claim 1, wherein the RF connector module comprises, a housing configured to couple to the RF connector and the RF cable, an orientation guide configured to key to the panel; and means for releasably coupling the housing to the panel.

4. The apparatus of claim 3, wherein the housing comprises an extension configured to extend through an opening in the panel to couple the RF connector with a complementary RF connector positioned behind the panel.

5. The apparatus of claim 3, wherein the orientation guide comprises a protrusion adapted for engaging an opening in the panel.

6. The apparatus of claim 3, wherein the orientation guide comprises a leg having feet adapted for engaging an opening in the panel so that the feet are positioned on an obverse side of the panel.

7. The apparatus of claim 3, wherein the means for releasably coupling the housing to the panel comprises a latch.

8. The apparatus of claim 7, wherein the latch is movable between a latch position for coupling the latch to the panel and a release position for moving the latch through an opening in the panel.

9. The apparatus of claim 1, further comprising:

a housing configured to couple to the RF connector and the RF cable;

an orientation guide configured to key to the panel;

means for releasably coupling the housing to the panel; and a strain relief.

10. The apparatus of claim 1, wherein the first connector assembly is a straight connector assembly and the second connector assembly is a right angle connector assembly.

11. An apparatus, comprising:

an RF connector;

an RF module configured to couple with the RF connector and an RF cable, the RF module configured to key and releasably secure to a panel and couple the RF connector to a complementary RF connector behind the panel; and a node housing element divided into a first portion and a second portion, the portions including a respective one of the connector assemblies, and wherein the first and second portions are secured together in a clamshell configuration such that opening and closing the node housing element allows the RF connectors to remain connected.

12. The apparatus of claim 11, wherein the RF module comprises:

a housing;

an orientation guide configured to key to the panel; and means for releasably coupling the housing to the panel.

13. The apparatus of claim 11, further comprising a strain relief.

14. The apparatus of claim 11, wherein the RF connector is a straight connector.

15. The apparatus of claim 11, wherein the RF connector is a right angle connector.

16. An apparatus, comprising:

a housing configured to couple to an RF connector and an RF cable and extend the RF connector through a panel for connection with a complementary connector;

an orientation guide configured to key the housing to the panel;

means for releasably coupling the housing to the panel; and a node housing element divided into a first portion and a second portion, the portions including a respective one of the connector assemblies, and wherein the first and second portions are secured together in a clamshell configuration such that opening and closing the node housing element allows the RF connectors to remain connected.

17. The apparatus of claim 16, further comprising a strain relief.

18. The apparatus of claim 16, wherein the housing is configured to couple with a straight RF connector.

19. The apparatus of claim 16, wherein the housing is configured to couple with a right angle RF connector.

20. The apparatus of claim 16, wherein the means for releasably coupling the housing to the panel comprises a releasable latch.

* * * * *